US006194995B1

(12) United States Patent
Gates

(10) Patent No.: US 6,194,995 B1
(45) Date of Patent: Feb. 27, 2001

(54) ARTICLE DISPENSER

(76) Inventor: Buster West Gates, 42 McComb, Edgewood, NM (US) 87015

( * ) Notice: Subject to any disclaimer, the term of this patent is extended or adjusted under 35 U.S.C. 154(b) by 0 days.

(21) Appl. No.: 09/299,723

(22) Filed: Apr. 26, 1999

Related U.S. Application Data

(60) Provisional application No. 60/094,909, filed on Jul. 31, 1998.

(51) Int. Cl.[7] ..... G08B 1/00

(52) U.S. Cl. ..... 340/309.15; 340/573.1; 221/2; 221/3; 206/531

(58) Field of Search ..... 340/309.15, 309.4, 340/309.5, 573.1; 221/2, 3, 15; 206/531, 534

(56) References Cited

U.S. PATENT DOCUMENTS

| | | | | |
|---|---|---|---|---|
| 2,953,242 | * | 9/1960 | Shaw | 206/42 |
| 3,261,455 | * | 7/1966 | Gayle et al. | 206/42 |
| 3,651,984 | | 3/1972 | Redenbach . | |
| 3,722,739 | | 3/1973 | Blumberg . | |
| 3,815,780 | * | 6/1974 | Bauer | 221/15 |
| 3,921,806 | * | 11/1975 | Wawracz | 206/534 |
| 4,361,408 | * | 11/1982 | Wirtschafter | 221/2 |
| 4,573,606 | * | 3/1986 | Lewis et al. | 221/2 |
| 4,942,544 | * | 7/1990 | McIntosh et al. | 340/309.4 |
| 5,044,516 | | 9/1991 | Hoar . | |
| 5,152,422 | * | 10/1992 | Springer | 221/2 |
| 5,246,136 | | 9/1993 | Loidl . | |
| 5,291,191 | * | 3/1994 | Moore | 340/825.19 |
| 5,323,929 | * | 6/1994 | Marlar | 221/3 |
| 5,392,952 | * | 2/1995 | Bowden | 221/3 |
| 5,495,961 | | 3/1996 | Maestre . | |
| 5,641,091 | * | 6/1997 | Daneshvar | 221/3 |
| 5,646,912 | * | 7/1997 | Cousin | 221/2 |
| 5,669,503 | * | 9/1997 | Robin | 206/528 |
| 5,724,021 | * | 3/1998 | Perrone | 340/309.15 |
| 5,850,937 | * | 12/1998 | Rauche | 221/2 |

OTHER PUBLICATIONS

Digital Alarm Clock Overview, Item No. 34908, excerpt from Specification Catalog; Sanyo Electric Co., Ltd., Semiconductor Business Headquarters, Tokyo, Japan.

* cited by examiner

*Primary Examiner*—Nina Tong
(74) *Attorney, Agent, or Firm*—Kevin Lynn Wildenstein, Esq.

(57) ABSTRACT

The present invention is an article dispenser comprising an alarm reminder device having an alarm, a clock and resettable electronic circuitry means for controlling the alarm and the clock, a medicine cup, a substantially hollow housing having a base attached to the alarm reminder device, the housing rotatably coupled to the base, the base having a means for transferring medicine including a pill slide formed therethrough and a foundation having an orifice formed therein adjacent to and below the pill slide, the aperture sized to receive the medicine retainer cup in a secure relationship, and electromechanical circuitry means for controlling the electronic circuitry means disposed upon the exterior surface of the base within the orifice, the electromechanical circuitry means for controlling in electrical communication with the electronic circuitry means, the medicine cup engaging the electromechanical circuitry means for controlling when the cup is disposed within the aperture, the three-way switch being disengaged when the cup is not disposed within the orifice. The present invention dispenses articles, such as medicinal tablets at a predetermined time every day while simultaneously audibly alerting a person to take the medicine.

16 Claims, 8 Drawing Sheets

PRIOR ART
ALARM REMINDER DEVICE

ARTICLE DISPENSER

This application claims the benefit under 35 U.S.C. Section 119(e) of the provisional application Serial No. 60/094,909 filed Jul. 31, 1998.

FIELD OF THE INVENTION

The present invention relates to an automatic dispenser, and more particularly, to a medicine dispenser such as for medicine, namely pills, which provides audible alerts throughout the day to persons who require medicine in a timely fashion.

BACKGROUND OF THE INVENTION

When required, persons take medication (in the form of capsules, pills or the like) on a set schedule over some period of time. In some cases, the schedule and time of ingesting medication is given by a doctor or pharmacist, whereas in other situations, the schedule and time of ingestion is dictated by the medication's directions. These types of persons may include persons who are chronically ill (who require medication to alleviate or assist in the recovery of the illness), women on birth control pills and other persons who require dietary, supplemental or hormonal therapy.

Initially, most people purchase medication which comes in a single compartment pill container (such as those provided in a pharmacy). Such pill containers, however, do not provide for orderly dispensing of the medication, and further, do not alert the user to take the medication in a timely, scheduled manner. Other pill containers are formed of a rectangular shaped box with individual compartments for the days of the week. Generally, these types of containers are elongated structures having a plurality of compartments, or boxes, that open up for receiving and storage of pills. Each compartment is labeled with each day of the week. However, these types of boxes do not remind the person requiring medication to physically ingest the medicine, but rather, only shows the person which days of the week they forgot to take the medicine.

To resolve this problem, several devices exist on the market today which alert a user to take medication. Some of these devices typically employ a programmable alarm which is connected to a medicinal container. Typical of such devices include disclosures in U.S. Pat. No. 5,641,091 to Daneshvar, U.S. Pat. No. 5,392,952 to Bowden and U.S. Pat. No. 5,152,422 to Springer. Some devices, such as that disclosed in U.S. Pat. No. 5,646,912 to Cousin, require the user to program the alarms based on a complex programming routine.

Moreover, devices, such as those disclosed in U.S. Pat. Nos. 3,921,806, 3,261,455 and 2,953,242 disclose medication dispensing units which have a large surface area. Such devices employ complex parts with elaborate designs to move pills into a pill dispensing area, which increases the likelihood that the medication will be broken or damaged. These types of units are believed to be difficult to store, difficult to access and overall, increases the complexity of a product which should not require complex tasks for the problem solved.

There are also devices which teach an alarm for the sole purpose of reminding a user to take the medicine. Typical of such disclosures include U.S. Pat. No. 5,724,021 to Perrone. These devices, however, are not connected to a medicinal container, and as such, merely serve as conventional alarm units. In all, most of these devices are believed costly, or at the very least, technically complicated to manufacture and/or use in operation. In this regard, persons who require medication on a timed interval may not be in a position to purchase costly reminder systems or be prepared to program or use complicated reminder systems.

As such, an article dispenser is desirable which is economical to make and easy to program by known, conventional standards, with fewer piece parts, less complexity and at a lower cost. Further, it is desirable that such an article dispenser be connected directly to a conventional programmable alarm unit (such as a low-cost alarm clock device found at local retail stores) for cost-efficiency, ease of use and convenience. In this manner, it is desirable that the existing electrical circuitry, which is already built in to the conventional alarm unit, control the alarm notification and dispensing of the articles from the article container, thereby eliminating the expense of a newly designed alarm unit, and also control the alarm notification to the patient. It is also desirable that the article dispenser be accessible to all types of persons, including children, the elderly, persons who are visually or hearing impaired, persons with failing memory and persons with other handicaps. Finally, it may be desirable to have an article dispenser capable of not only dispensing medicine, but other articles such as candy, gum or like small items.

SUMMARY OF THE INVENTION

The present invention relates to a single article dispenser, and more particularly to a medicinal dispenser controlled by electrical circuitry on an attached conventional alarm reminder device (such as an alarm clock). The present invention includes a means for dispensing medicine attached to an alarm reminder device (such as an alarm clock). The present invention utilizes the alarm circuitry of an alarm clock, which controls the engagement of the alarm on the alarm reminder device, to also control the operation of the means for dispensing medicine. The alarm circuitry preferably allows a patient to set the alarm reminder device to produce an alarm signal times at least once during each 24 hour period. Preferably, the alarm reminder device is commercially available and low cost. At a minimum, the alarm reminder device must have a three-way alarm switch for use with the present invention.

The present invention is highly useful for those persons who do not take their medicine as prescribed by medical professionals or as directed on the medicine's container. The present invention is intended to provide an apparatus which is simple to use and manually operated by the user.

DETAILED DESCRIPTION OF THE INVENTION

Figure 1:
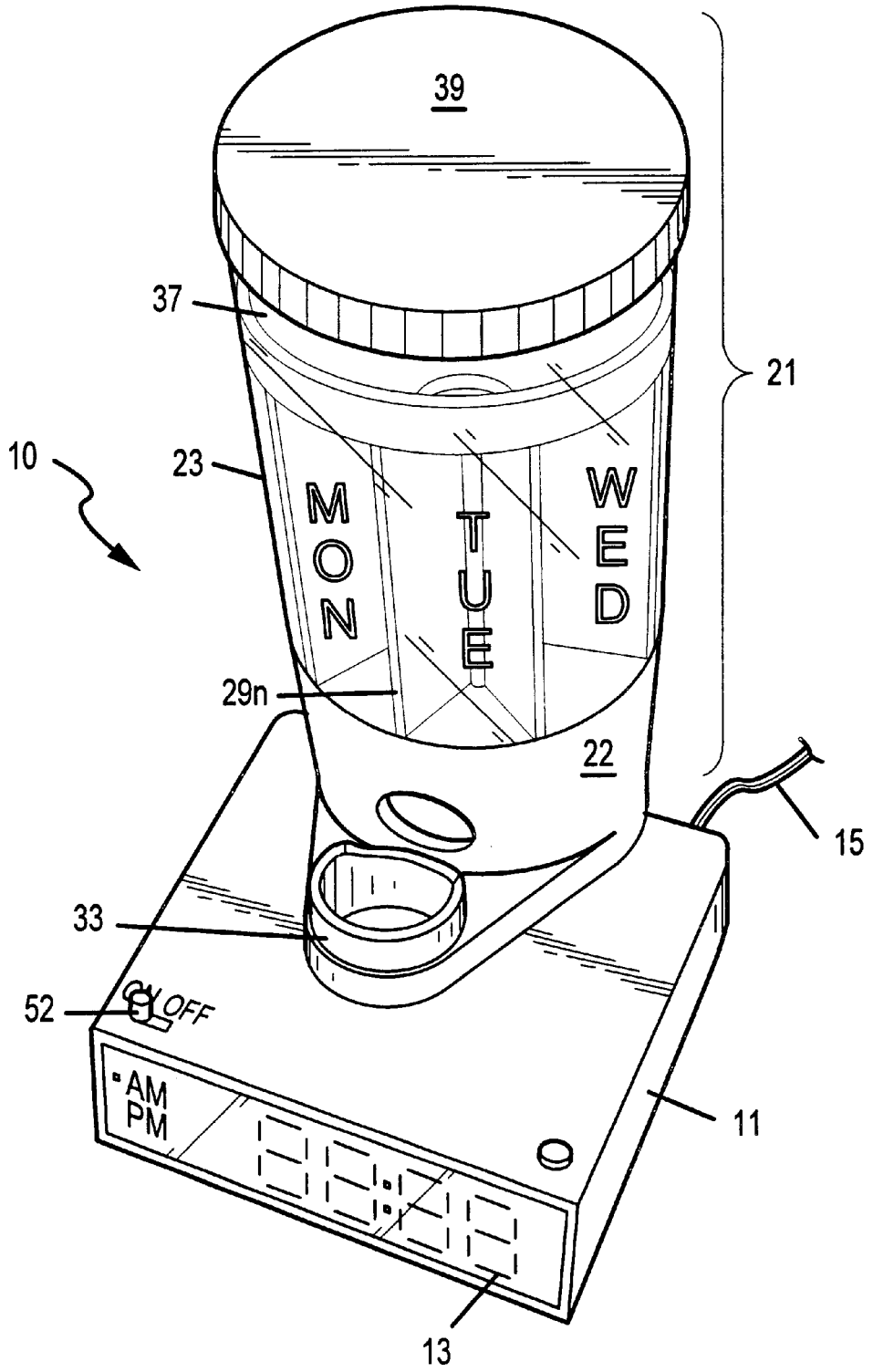
FIG. 1 is a perspective view of the present invention.
Figure 2:
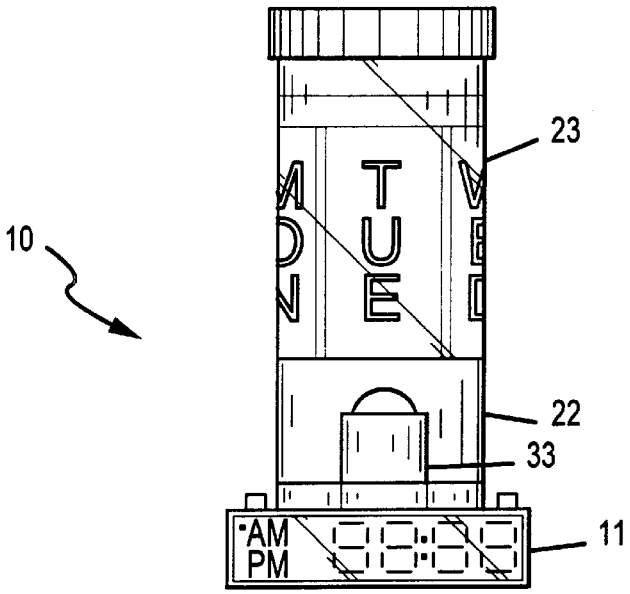
FIG. 2 illustrates a front side view of the present invention.
Figure 3:
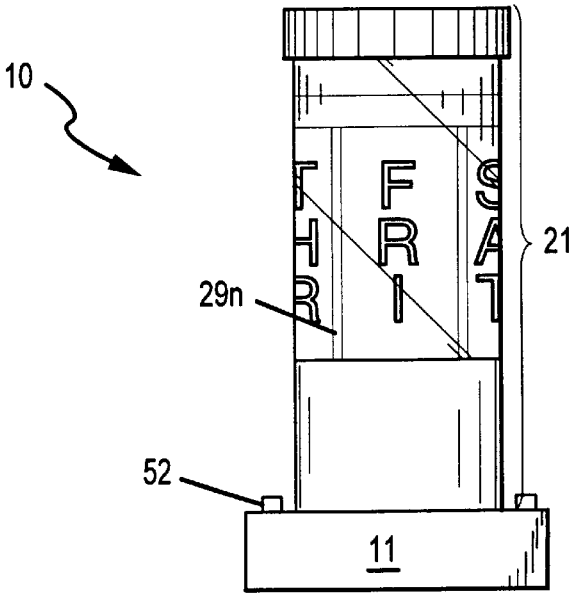
FIG. 3 illustrates is a rear side view of the present invention.
Figure 4:
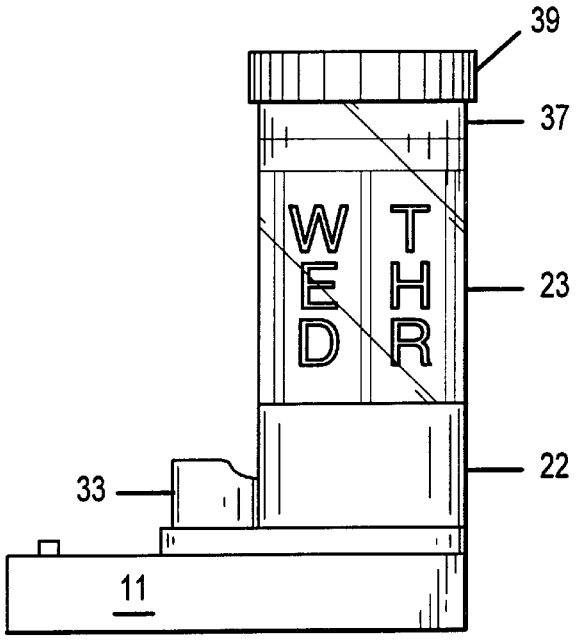
FIG. 4 illustrates a ride side view of the present invention.

As seen in FIGS. 1–5, the present invention is an article dispenser 10 having an alarm reminder device 11 electronically connected to a means for dispensing medicine 21.

The alarm reminder device 11 is preferably a conventional, low cost clock or clock/radio component found at retail stores. As such, alarm reminder device 11 includes an alarm reminder device 11 (such as a digital clock having audio alarm capabilities in electrical communication with a built-in audio speaker or a visual means). Those of skill in the art will realize that alarm reminder device 11 is powered by conventional electrical line current through power cord 15 or can be operated by another power source such as a battery-powered clock. In this regard, conventional electrical line-powered alarm reminder devices with built-in battery back up are preferred, because power failure can inactivate the alarm reminder device causing patients to become frustrated or anxious when they are uncertain when they will receive the medication and at the proper time. Thus, employing an alarm reminder device with built-in battery back up source will allow a patient to receive medication from the alarm reminder device on time, whether conventional electricity is available for the alarm reminder device or not.

The means for dispensing medicine 21 includes a substantially cylindrical, but hollow, housing 23 of predetermined height rotatably attached to the alarm reminder device 11 through base 22. Base 22 is a rigid structure for secure attachment to the alarm reminder device 11 by any conventional means (such as, for example, glue or by a conventional nut and bolt coupling) which will allow housing 23 to rotate upon base 23.

Figure 11:
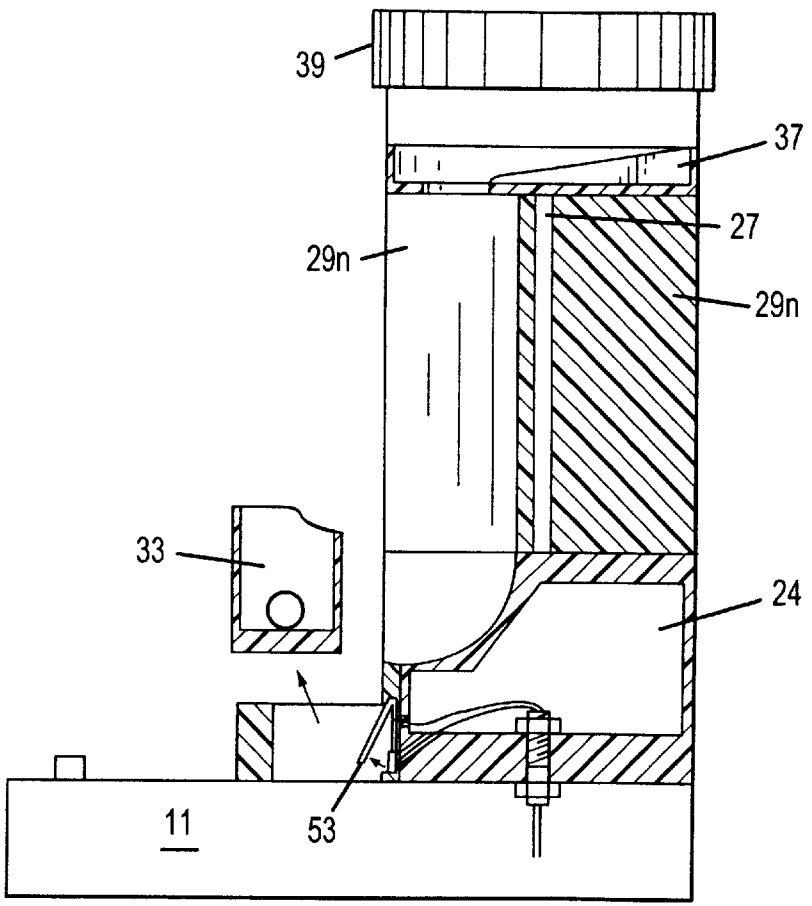
FIG. 11 is a right side perspective view of FIG. 1 illustrating the medicine dispenser cup in the base's aperture of the present invention disengaging the three way switch.
Figure 10:
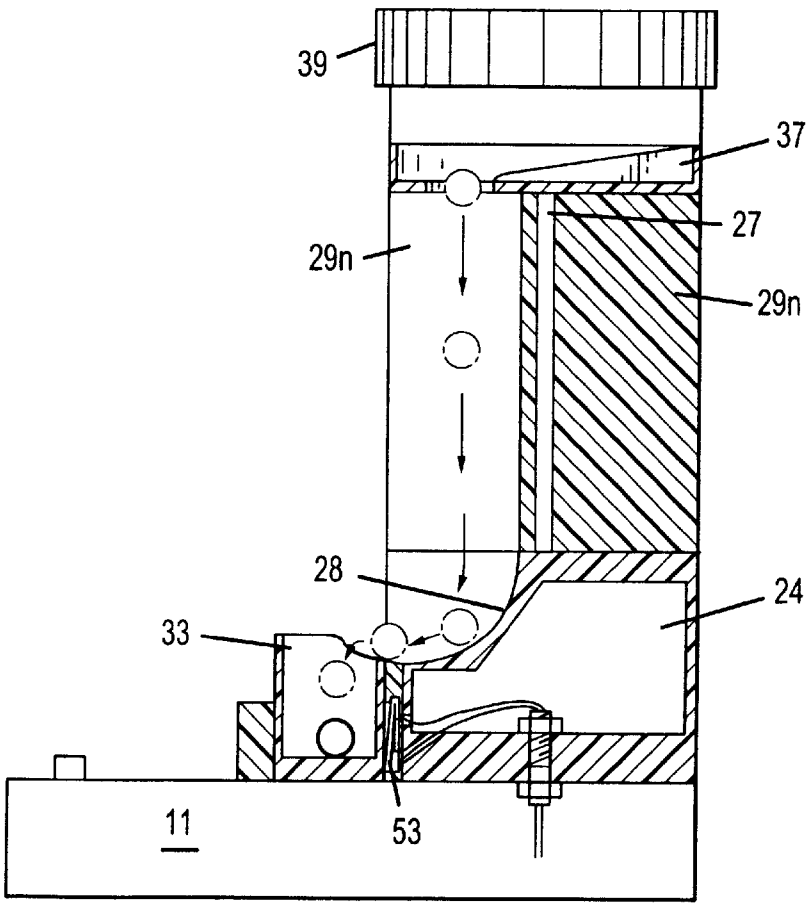
FIG. 10 is a right side perspective view of FIG. 1 illustrating the medicine dispenser cup in the base's aperture of the present invention engaging a three way switch.

Within base 22 is formed a hollow cavity 24 (as seen in FIGS. 10 and 11) in which a means for transferring medicine 26 is placed. Means for transferring medicine 26 is a substantially solid structure securely fittable within cavity 24 which includes a pill slide 28 formed therethrough. Pill slide 28 is of predetermined diameter to allow medicine, such as pills, capsules, caplets or tablets, to travel from compartment $\mathbf{31}_n$ within housing 23 to medicine retainer cup 33. Coupled to the exterior surface of base 22 is protruding foundation 24 having a circular aperture 35 formed therein adjacent to and below pill slide channel 28. Aperture 35 is sized to receive medicine retainer cup 33 in a secure relationship. Further, three-way switch 53 (such as subminiature lever switch 275-016A sold by Radio Shack), whose function is described below, is disposed upon the exterior surface of base 22 but within aperture 35 for engagement with medicine retaining cup 33.

Figure 6:
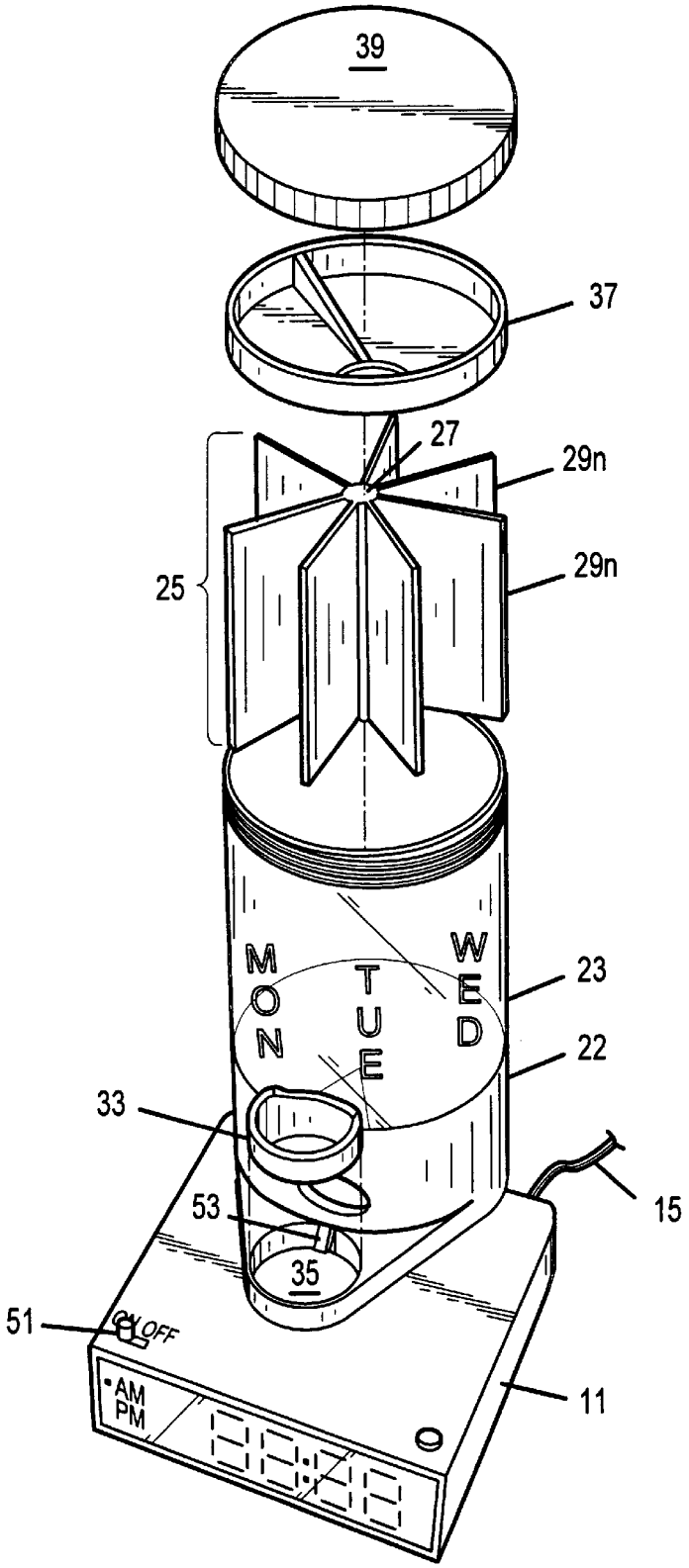
FIG. 6 is an exploded perspective view of the invention illustrated in FIG. 1.

Preferably, housing 23 is formed of a clear or translucent material which will allow the user to determine the contents placed within housing 23. Within housing 23 is placed rim 25. While rim 25 fits within housing 23, rim 25 is preferably structured of lower height than housing 23 and is defined by a rigid vertical hub 27 which is attached to a plurality of outwardly-projecting spokes $\mathbf{29}_n$. The length of each spoke $\mathbf{29}_n$ depends on the interior diameter of housing 23 so that when rim $\mathbf{29}_n$ is securely placed within or integrally attached with housing 23, hub 27 is located substantially in the center of hollow cylinder housing 23 as illustrated in FIG. 6.

Figure 5:
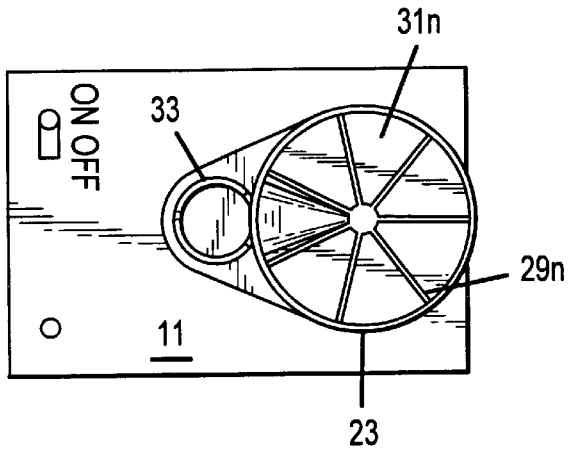
FIG. 5 illustrates a top side view of the present invention.

Further, when rim 25 is placed within housing 23, a plurality of compartments $\mathbf{31}_n$ are defined between spokes $\mathbf{29}_n$ within housing 23, each compartment $\mathbf{31}_n$ defined to retain a plurality of small articles, preferably medicinal pills, capsules, caplets and the like. As seen in FIGS. 5–6, a maximum of seven compartments are formed to correspond to the seven days in a Gregorian calendar week, however those of skill in the art will realize that added (or less) compartments can be formed depending on the end use application. Upon the top of housing 23 is attached lid 39. Lid 39, in the preferred embodiment, is a child proof safety cap that attaches to the top of housing 23 securely.

As an option which can be incorporated into the preferred embodiment, the circumferential space occupied by one of the compartments can be labeled "fill" and is different from all the other compartments. In particular, the fill compartment would occupy only thirty-eight degrees (38°) of interior circumferential space within housing 23, whereas the remaining compartments occupy an equal forty-six degrees (46°) of interior circumferential space.

As those of skill in the art will appreciate, the rotation of means for dispensing 21 can be controlled by different means, such as manually, mechanically or electronically. In the preferred embodiment, the rotation of means for dispensing is controlled manually, which provides the user with control over the operation of the present invention. In this fashion, a user can have the present invention dispense pills from selected compartments at selected time intervals as notified. However, as those of skill in the art will appreciate, base 23 could be designed to include an electromechanical means (not shown) placed within cavity 24 which interfaces with alarm reminder device 11 for electromechanically rotating housing 23. While this embodiment may cost more to implement, it may be preferable for use by patients who have trouble with manual dexterity.

Preferably, the exterior of housing 23 is labeled Fill, Sunday, Monday, Tuesday, Wednesday, Thursday, Friday, and Saturday. These markings should be raised plastic and used to indicate the day of the week for the pills that one has been taking. Directional arrows on the cap showing the rotation of the cylinder necessary to dispense the pills can also be built into the unit.

Figure 9:
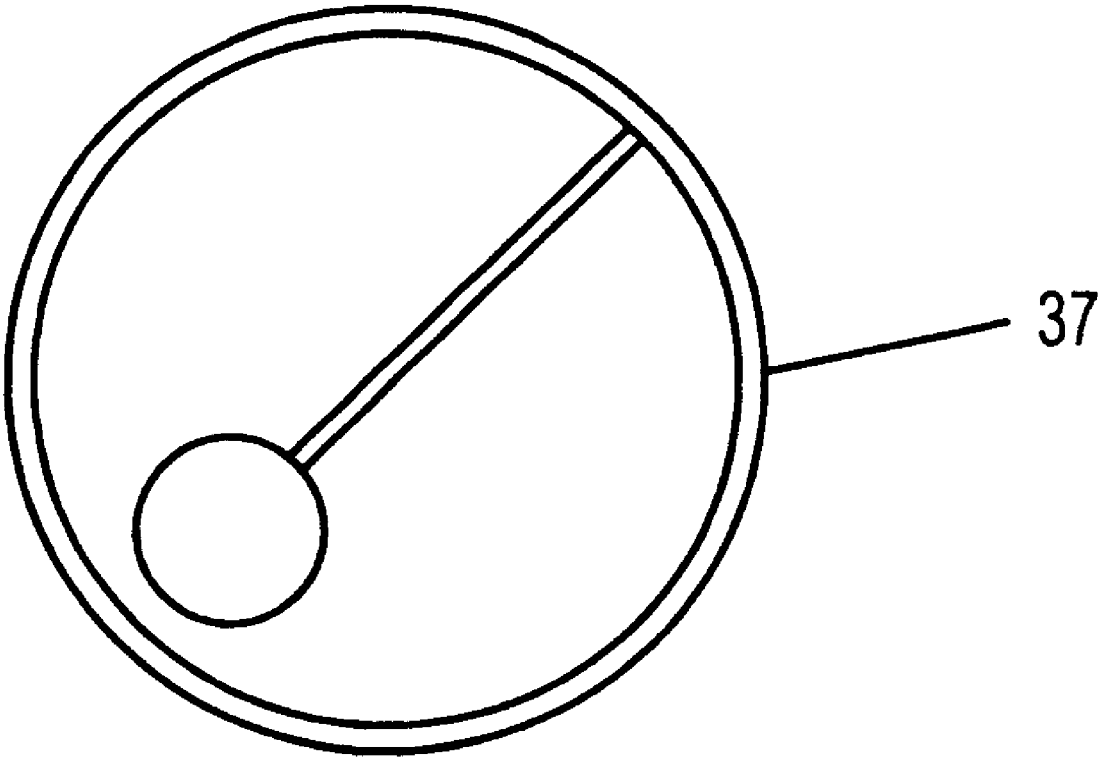
FIG. 9 is a top view of the optional filler cap of the present invention.

Optionally, as seen in FIG. 9, filler cap 37 can be employed within housing 23. Filler cap 37 is a substantially rigid structure fittable within housing 23 and having an offset aperture formed therein of predetermined diameter. The aperture's diameter, of course, is sized and shaped to accommodate the size and shape of medicine to be dispensed, and assists with loading medicine into the housing's compartments $\mathbf{31}_n$.

Figure 7A:
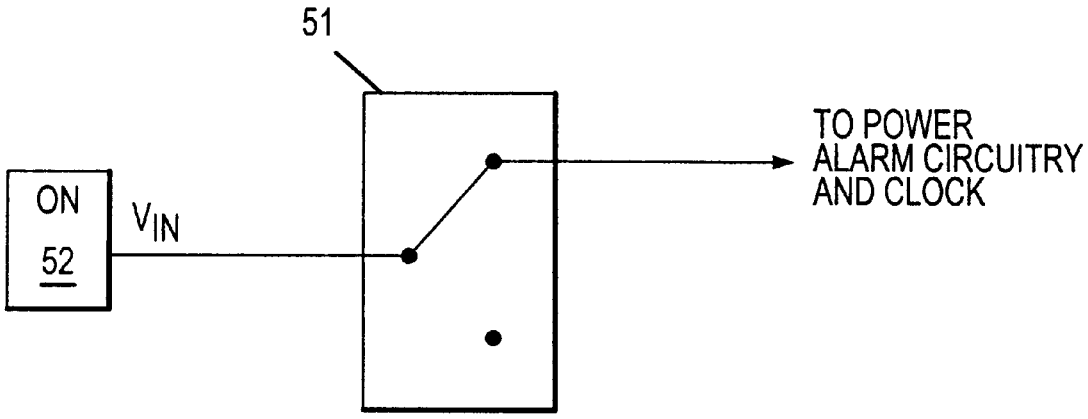
FIGS. 7*a* and 7*b* illustrate electric schematics for the alarm circuitry employed in prior art alarm reminder devices.
Figure 7B:
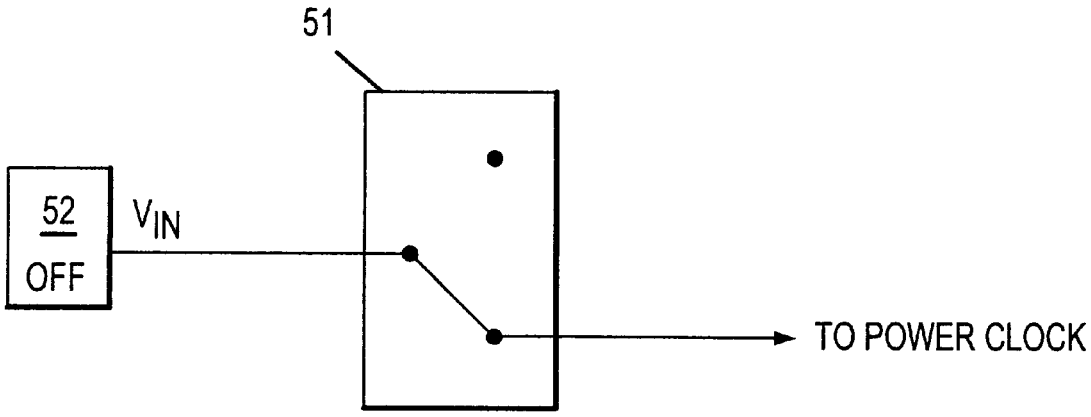

As seen in FIGS. 7*a* and 7*b*, many conventional resettable alarm reminder devices are believed to work in the following fashion, employing electromechanical circuitry means. Each reminder device employs a three-way switch 51 which is electrically connected to a toggle switch 52 on the exterior of the device. When toggle switch 52 is placed in the alarm position (or, "on" position), three-way switch 51 electrically controls and engages the alarm circuitry in the device (such as Sanyo's digital alarm integrated circuit chip LM8560N) as seen in FIG. 7*a*, providing power to the alarm, which in turn, powers the clock. When toggle switch 52 is placed in the alarm disarm position (or, "off" position), three-way switch 51 electrically disconnects from and disengages the alarm circuitry in the device as seen in FIG. 7*b* while simultaneously continuing to provide power only to the clock while resetting the alarm. This type of alarm circuitry is low cost and inexpensive to incorporate into a reminder device 11.

Figure 8A:
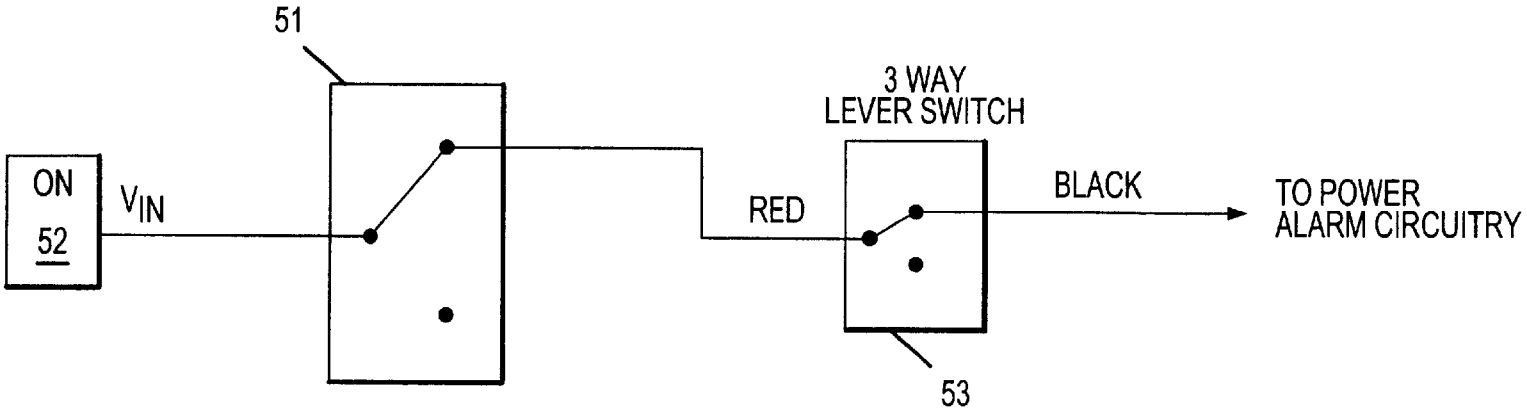
FIGS. 8*a* and 8*b* illustrate electric schematics for the present invention employing prior art alarm circuitry.
Figure 8B:
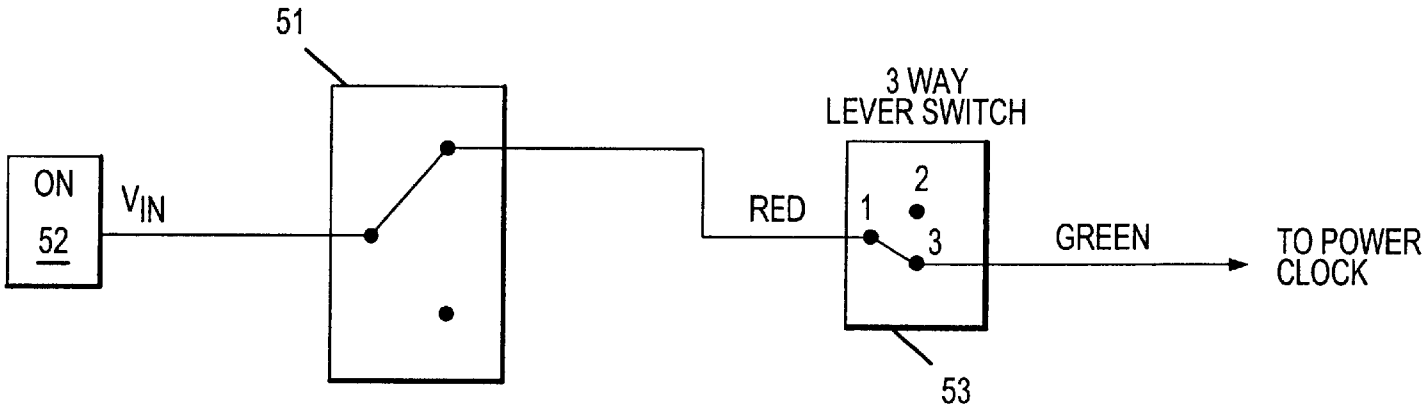

The present invention relies on the resettable alarm circuitry described above or substantially similar circuitry means. For example, as seen in FIGS. 8*a*–8*b*, the present invention utilizes the steady-state status of circuit 51 to control the arming and disarming of an alarm. When toggle switch 52 is placed in the alarm position (or, "on" position), three-way switch 51 (disposed upon exterior surface of base 22 and within aperture 35 as seen in FIG. 6) electrically connects to three-way lever switch 53 as seen in FIG. 8*a*, which in turn, provides providing power to the alarm and clock. As implied from FIG. 6, the only time three-way lever switch 53 is short circuited (or closed) is when medicine retainer cup 33 is sitting within aperture 35, thereby engaging (or closing) switch 53. When a patient removes medicine retainer cup 33 from aperture 35, switch 53 is disengaged (or, open circuited). Thus, in this fashion as seen in FIG. 8*b*, even though toggle switch 52 is set in the "on" position, when switch 53 is disengaged, only the clock is powered, yet the alarm will be turned off and reset. In this fashion, the alarm in the present invention will disarm and reset only after medicine retainer cup 33 from aperture 35, thereby indicating that a patient has affirmatively taken the action of removing the medicine retainer cup 33 to ingest the medication.

Those skilled in the art will realize that the present invention can be used to dispense articles other than medicine. For example, the present invention could be employed to dispense candy such as gum balls. In particular, the present invention could dispense various sized gum balls.

Other variations and modifications of the present invention will be apparent to those of ordinary skill in the art, and it is the intent of the appended claims that such variations and modifications be covered. The particular values and configurations discussed above can be varied, are cited to illustrate particular embodiments of the present invention and are not intended to limit the scope of the invention. It is contemplated that the use of the present invention can involve components having different characteristics as long as the principle, the presentation of a dispenser, is followed.

I claim:

1. An apparatus for dispensing articles comprising:

a. an alarm reminder device having an alarm, a clock and resettable electromechanical circuitry means for controlling the alarm and the clock;

b. a medicine retainer cup;

c. a means for dispensing medicine, the means for dispensing further comprising a substantially cylindrical, hollow housing of predetermined height and having a base, the housing rotatably attached to the alarm reminder device through the base, the base further comprising means for transferring medicine having a pill slide formed therethrough and a foundation having a circular aperture formed therein adjacent to and below the pill slide, the aperture sized to receive the medicine retainer cup in a secure relationship; and d. a three-way switch disposed upon the exterior surface of the base within the aperture, the three-way switch in electrical communication with the circuitry means for controlling the alarm and the clock, the medicine retainer cup engaging the three-way switch when the cup is disposed within the aperture, the three-way switch being disengaged when the cup is not disposed within the aperture.

2. The apparatus of claim 1 further comprising a rim fittable within the housing, the rim including a rigid vertical hub attached to a plurality of outwardly-projecting spokes defining a plurality of compartments within the housing, the rim being fittable within the housing so that the hub is located substantially in the center of the housing.

3. The apparatus of claim 2 further comprising a circular filler cap fittable within the hollow interior of the housing, the filler cap having an aperture formed therein offset from a center point on the cap, the aperture being in approximate registry with one of the compartments when fitted within the hollow interior.

4. The apparatus of claim 3 wherein the housing is formed of translucent material.

5. The apparatus of claim 4 wherein the alarm is audible.

6. The apparatus of claim 4 wherein the alarm is visible.

7. The apparatus of claim 4 wherein the alarm is audible and visible.

8. A device for dispensing medicine in pill, capsule, tablet or like form, comprising:

a. an alarm reminder device having an electronic circuitry;

b. A means for dispensing medicine comprising a hollow covering having a base which is rotatable upon the alarm reminder device through the base, the base further comprising means for transferring medicine having a pill slide formed therethrough and a foundation protruding from the base, the foundation having a cavity formed therein adjacent to and below the pill slide;

c. A pill retainer cup, the cavity sized to retain the pill retainer cup in a removable relationship; and d. electromechanical circuitry means for controlling the electronic circuitry, the circuitry means for controlling disposed within the base and upon the exterior surface of the base, the circuitry means for controlling being in electrical communication with the electronic; and e. a rim fittable within the covering, the rim having a rigid vertical hub attached to a plurality of outwardly-projecting spokes, the rim being fittable within the covering so that the hub is located substantially in the center of the covering.

9. The device of claim 8 wherein an area between adjacent outwardly-projecting spokes and the covering defines at least one pill compartment.

10. The device of claim 9 wherein at least seven pill compartments are formed.

11. The device of claim 10 further comprising a circular filler cap fittable within the hollow interior of the covering, the filler cap having an opening formed therein offset from a center point on the cap, the opening being in approximate registry with one of the pill compartments when fitted within the hollow interior.

12. The device of claim 11 wherein the covering is formed of translucent material.

13. The device of claim 11 wherein the alarm is audible.

14. The device of claim 11 wherein the alarm is visible.

15. The device of claim 11 wherein the alarm is audible and visible.

16. A dispenser for medications comprising:

a. an alarm reminder device having an alarm, a clock and resettable electronic circuitry means for controlling the alarm and the clock;

b. a medicine cup;

c. a substantially hollow housing having a base attached to the alarm reminder device, the housing rotatably coupled to the base, the base having a means for transferring medicine including a pill slide formed therethrough and a foundation having an orifice formed therein adjacent to and below the pill slide, the aperture sized to receive the medicine retainer cup in a secure relationship; and d. electromechanical circuitry means for controlling the electronic circuitry means disposed upon the exterior surface of the base within the orifice, the electromechanical circuitry means for controlling in electrical communication with the electronic circuitry means, the medicine cup engaging the electromechanical circuitry means for controlling when the cup is disposed within the aperture, the three-way switch being disengaged when the cup is not disposed within the orifice;

e. a rim fittable within the housing, the rim including a rigid vertical hub attached to a plurality of outwardly-projecting spokes, the rim being fittable within the housing so that the hub is located substantially in the center of the housing so that an area between adjacent outwardly-projecting spokes and the housing defines at least one pill compartment; and f. a circular filler cap fittable within the hollow interior of the housing, the filler cap having an hole formed therein offset from a center point on the cap, the hole being in approximate registry with one of the pill compartments when fitted within the housing.

* * * * *